US006369685B1

(12) United States Patent
Milavec et al.

(10) Patent No.: US 6,369,685 B1
(45) Date of Patent: Apr. 9, 2002

(54) MULTI-LAYER PLANAR INDUCTANCE COIL AND A METHOD FOR PRODUCING THE SAME

(75) Inventors: Johann Milavec, Windisch; Alain Chapuis, Riedikon, both of (CH)

(73) Assignee: Melcher A.G., Uster (CH)

( * ) Notice: Subject to any disclaimer, the term of this patent is extended or adjusted under 35 U.S.C. 154(b) by 0 days.

(21) Appl. No.: 09/462,403

(22) PCT Filed: Jul. 10, 1998

(86) PCT No.: PCT/EP98/04310

§ 371 Date: Jan. 7, 2000

§ 102(e) Date: Jan. 7, 2000

(87) PCT Pub. No.: WO99/03117

PCT Pub. Date: Jan. 21, 1999

(30) Foreign Application Priority Data

Jul. 10, 1997 (DE) ..... 197 29 547
Jan. 23, 1998 (DE) ..... 198 02 473

(51) Int. Cl.[7] ..... H01F 5/00

(52) U.S. Cl. ..... 336/232; 336/200; 336/83; 336/223

(58) Field of Search ..... 336/200, 232, 336/223, 83; 29/602.1, 606; 174/250; 361/761

(56) References Cited

U.S. PATENT DOCUMENTS

| | | | | |
|---|---|---|---|---|
| 4,076,356 A | | 2/1978 | Tamburro | 339/17 C |
| 5,319,342 A | * | 6/1994 | Kuroki | 336/170 |
| 5,321,380 A | | 6/1994 | Godek et al. | 336/232 |
| 5,949,321 A | * | 9/1999 | Grandmont et al. | 336/232 |
| 6,073,339 A | * | 6/2000 | Levin | 29/606 |
| 6,211,767 B1 | * | 4/2001 | Jitaru | 336/200 |
| 6,239,683 B1 | * | 5/2001 | Roessler et al. | 336/200 |

* cited by examiner

*Primary Examiner*—Anh Mai
(74) *Attorney, Agent, or Firm*—Carter & Schnedler, P.A.

(57) ABSTRACT

The invention relates to a multi-layer planar inductance coil on a portion of a first plate-shaped support (10) which has a plurality of first conducting layers (14) which extend substantially parallel to each other and which is designed for holding and contacting further electronic components (32), wherein at least one conducting layer (14) of the first support, which forms a first electrical winding, is arranged for co-operation with a core (24) which is provided for guiding a magnetic flux and which is to be arranged in the portion, wherein at least one second plate-shaped support (20; 22; 44; 54) with a plurality of second conducting layers (16; 18) which extend substantially parallel to each other is so arranged in the portion parallel to the first support (10) that at least one conducting layer (16) of the second support, which provides a second electrical winding, can inductively co-operate with the core (24) and the first electrical winding.

9 Claims, 3 Drawing Sheets

MULTI-LAYER PLANAR INDUCTANCE COIL AND A METHOD FOR PRODUCING THE SAME

The present invention concerns a multi-layer planar inductance coil as set forth in the classifying portion of claim 1 and a process for producing such a multi-layer planar inductance coil.

Planar inductors of that kind are used for example in switching power supplies, voltage transformers or other items of equipment in power electronics, which are designed on the basis of a multi-layer support plate (so-called "multi-layer" or "multi-layer print plate") which has a plurality of conductor layers which are electrically insulated from each other. More precisely, such a multi-layer support plate, besides electronic components for the switching electronics which are suitably connected by one or more conductor tracks of the multi-layer plate, has inductance coils such as transformers or chokes for which conducting layers (in mutually superposed relationship) of the multi-layer plate perform the functions of the windings—that is to say for example the primary or secondary winding of a transformer—: for that purpose a transformer core is fitted suitably through an opening in the multi-layer plate and then forms the desired transformer, together with the windings formed on the conducting layers of the multi-layer plate.

It is then possible in that way to produce an item of equipment which is of a compact structure and which is stable in regard to thermal and mechanical properties and which is markedly superior to other conventional design configurations—for example a discrete transformer on a conventional print plate—and is particularly suitable for commercial use.

Figure 6:
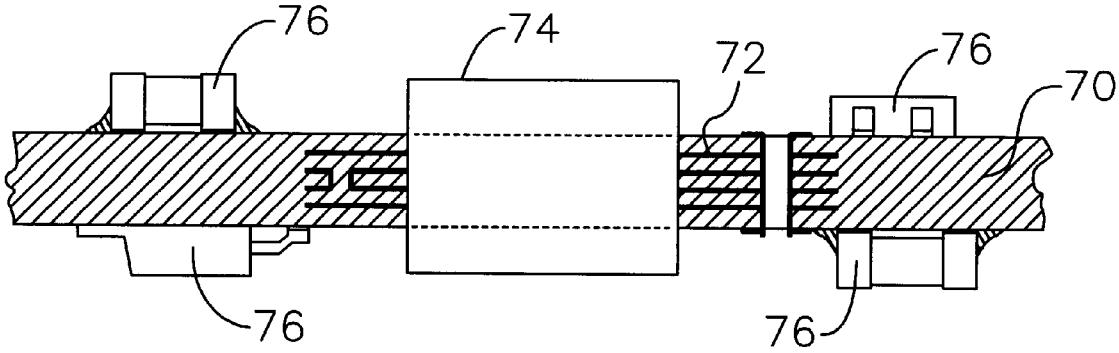

FIG. 6 relating to the state of the art shows in the sectional side view therein the structure of such a planar inductance coil constituting the general kind of device involved.

Mounted on a portion, forming a planar inductor, of a multi-layer plate 70 which has a plurality of electrically conducting layers 72 is a diagrammatically shown transformer core 74 which—approximately E-shaped in side section—extends with limbs (not shown in the Figure) through openings of suitable size in the multi-layer plate 70. In that respect, to co-operate with the transformer core 74 the conducting layers constitute a corresponding primary or a secondary winding so that in the illustrated manner the inductor is directly embedded into the peripheral electronics diagrammatically indicated with the further electronic components 76, or is connected thereto by way of corresponding conducting layers 72.

The structure shown in FIG. 6 thus provides an extremely compact, electrically and mechanically stable arrangement which in addition is also extremely suitable for mass production by virtue of the good reproducibility of the geometrical dimensions involved.

Depending on the respective purpose of use and the specifically designed electronic unit, it is possible in that way to implement one or more planar inductance coils on or in a multi-layer plate, although in this case the inductance coils usually occupy only a fairly small part of the multi-layer plate surface or mounting surface.

It has been found however that there is the disadvantage in terms of using that technology in the context of a product program with a relatively large number of alternative structural configurations that a special design for the associated multi-layer plate must be implemented for each individual or separately produced alternative configuration; thus, particularly in the case of power supply circuits, it is necessary to afford both the primary side and also the secondary side of the (planar) transformer for a plurality of different voltages or voltage ranges, for example also dimensioned by the selected number of relevant conducting layers for the transformer (corresponding to a number of windings of the transformer). With for example five possible different primary voltages and five appropriate different secondary voltages, accordingly there would be 25 alternative product configurations of an electronic device, which each require a separate multi-layer plate which is specifically designed for the respectively desired voltage combination, with diversification occurring only in the region of the respective planar inductance coil or coils.

If it is then borne in mind that in particular multi-layer plates with a relatively high number of layers (for example eight or eleven layers), compared to multi-layer plates with a low number of layers, give rise to over-proportionally high purchase costs and accordingly storage costs, in particular the desired flexible use of the multi-layer technology is extremely expensive and is not competitive with conventional technology when an increasing multiplicity of alternative design configurations is involved.

Therefore the object of the present invention is to provide an arrangement of the general kind set forth, having a multi-layer planar inductance coil, the manufacture of which can be simplified and made flexible in regard to possible variations in the inductance coil windings, while in particular also the provision and stocking of the expensive plate-shaped supports which are in the form of multi-layer plates can be simplified.

That object is attained by the multi-layer planar inductance coil having the features of claim 1 and the method having the features of claim 9.

Advantageously in that respect the second multi-layer member which is provided in said portion and which is preferably also limited with its dimensions to that portion permits the flexible, variable addition of additional conducting layers and thus inductor windings to the first conducting layers which are already present in the base multi-layer member (the first plate-shaped support) so that by suitably applying and configuring one or more locally limited multi-layer members it is possible to produce the inductance coil required for a respective alternative product configuration, at low cost, without the need for example to provide a special, separate multi-layer complete design for that alternative product configuration.

As moreover a relatively large number of electrical conducting layers is generally required only in the region of the planar inductance coil, but not for the surrounding peripheral electronics, it is in accordance with the invention and advantageously possible for the peripheral electronics to be implemented on the first support with a small number of conducting layers (at a corresponding low level of cost), while it is only in the region of planar inductance coil that the required additional conducting layers are locally and selectively afforded by the provision of one or more additional multi-layer members.

Accordingly the expensive multi-layer material is then put to optimum use.

In addition is advantageously possible by means of the present invention to develop a manufacturing system which is suitable for a large number of alternative configurations and which includes components that embrace the alternative configurations, on the first, plate-shaped support, while components which are specific to alternative configurations—besides additional windings, possibly also additional, specifically necessary peripheral electronics—are contained on the additional support or supports. The structural expenditure and stock-keeping for a large number of alternative design configurations are therefore drastically reduced.

Advantageous developments of the invention are set forth in the appendant claims.

Thus, it is possible in accordance with the invention to provide on one or both sides of the base support (the first support) one or more of the additional multi-layer supports which are limited to the specific region of the inductance coil, while in particular when mounting at both sides is involved, that can afford an arrangement involving maximum compactness.

The invention is also particularly suitable in regard to use of the planar inductance coil as a transformer as here the primary winding and the secondary winding can be directly associated with the conducting layers of the first and the second supports respectively and it is thus possible to directly influence the turns ratio depending on the respective specification concerned.

In accordance with the invention there are various possible ways of suitably connecting the second support mechanically (and also electrically) to the basic first support, in which respect a soldered connection in the lateral region of the second support has proven to be particularly suitable and preferred in terms of strength and mechanical load-bearing capability. Such an arrangement could further advantageously be supplemented or further stabilised by a (possibly additional) adhesive connection of the conductor layers.

All in all the present invention affords a planar inductance coil system which can be put to flexible use and which on the basis of the advantageous multi-layer technology affords the option of substantial production and logistical optimization.

Figure 1:
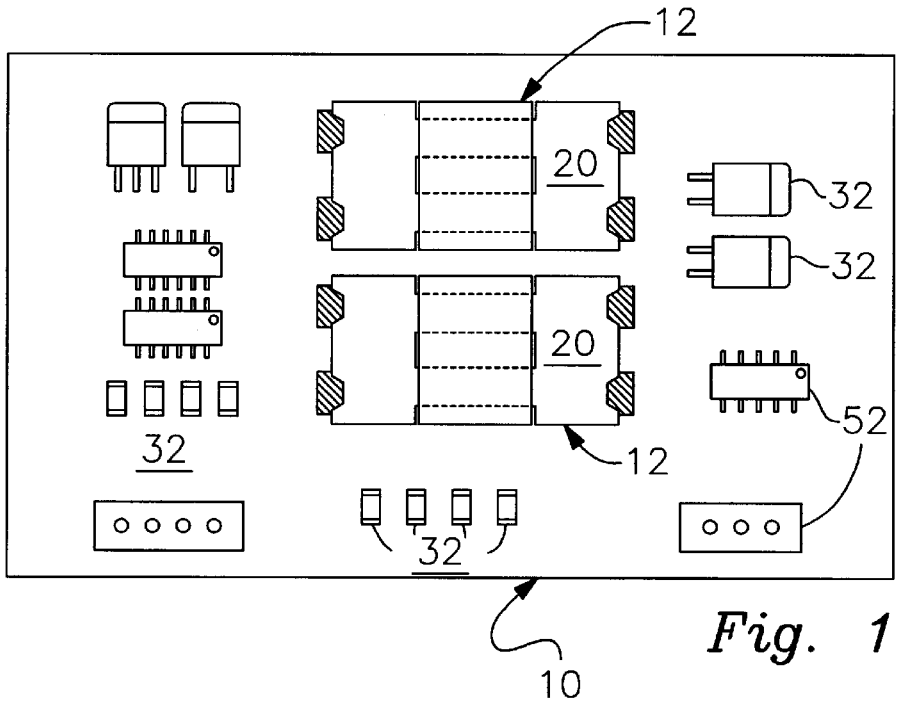
Figure 2:
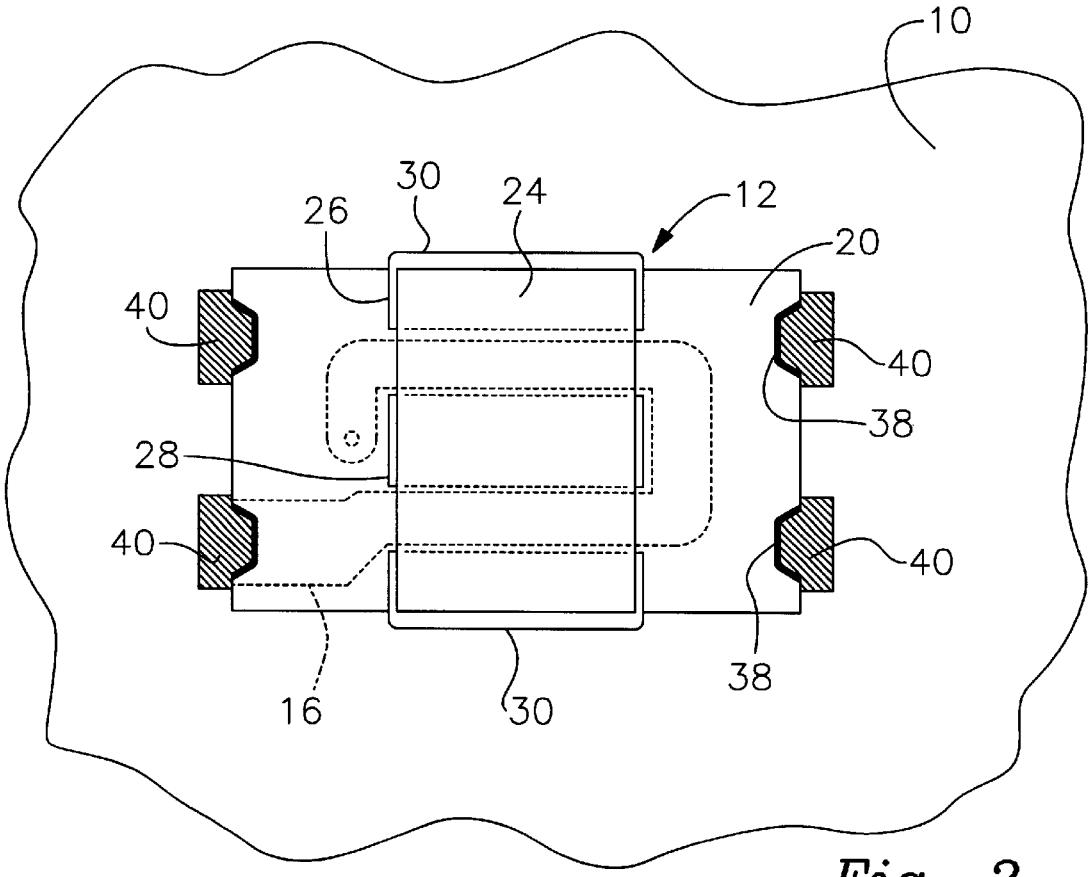
Figure 3:
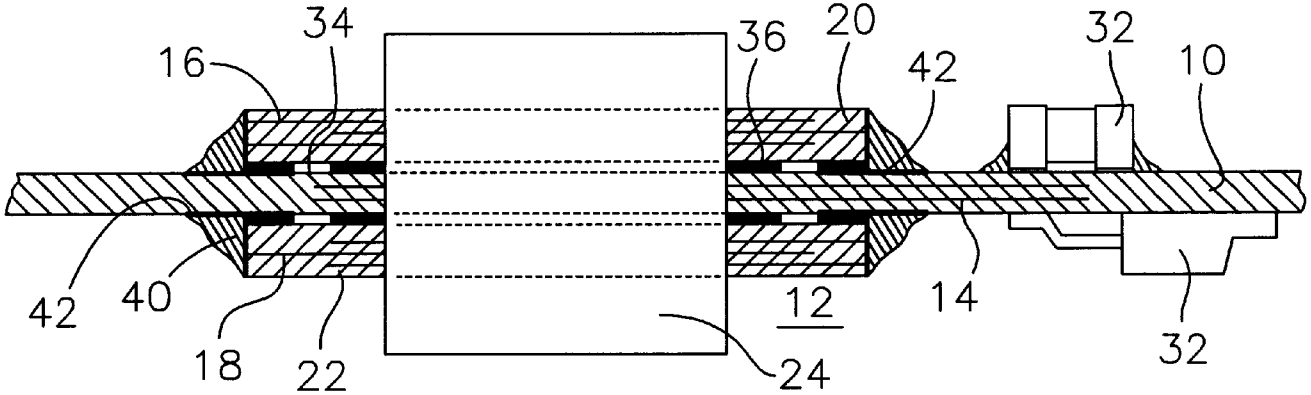
Figure 4:
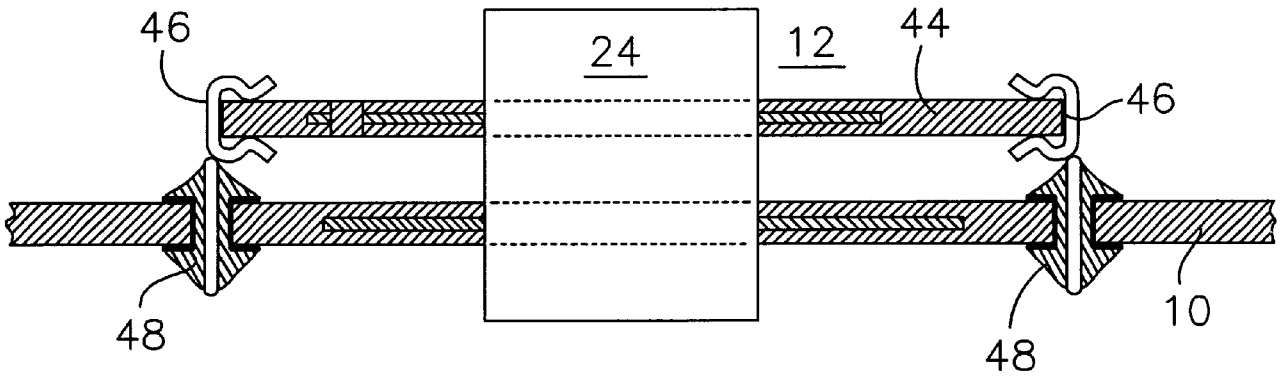
Figure 5:
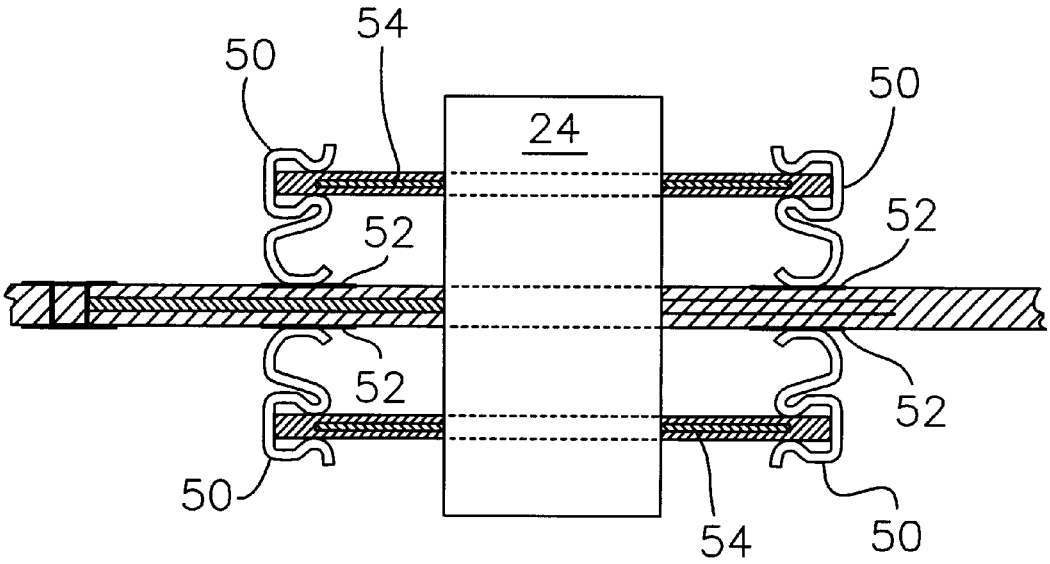

Further advantages, features and details of the invention will be apparent from the description hereinafter of embodiments by way of example and with reference to the drawings in which:

FIG. 1 is a plan view of an electronic switching device implemented on a multi-layer member, with a pair of planar inductance coils on a portion of the multi-layer member, FIG. 2 is a partial plan view of a planar inductance coil of the structure shown in FIG. 1, FIG. 3 is a partly sectional side view of the multi-layer planar inductance coil shown in FIG. 2 and in accordance with a preferred embodiment of the invention (best mode), FIG. 4 shows a second alternative embodiment of the invention with second multi-layer portion which is clamped on at one side, FIG. 5 shows a third embodiment of the invention with multi-layer portions clamped on at both sides of the base multi-layer member, for forming the planar inductance coil, and FIG. 6 is a sectional side view of a conventional multi-layer planar inductance coil to illustrate the state of the art.

Referring to FIG. 1 a multi-layer card 10, for example of the external format of a European card, carries a pair of planar inductance coils in the form of planar transformers which are arranged at the center of the card 10 and which occupy about 20% of the card surface area.

Each planar transformer 12 is electrically implemented by means of a secondary winding which is afforded by conducting layers 14 of the multi-layer card 10 (basic multi-layer member), and by a primary winding which is afforded by conducting layers 16 and 18 of first and second additional multi-layer portions 20 and 22 respectively provided on both sides of the basic multi-layer member.

Passing through the conducting layers 14 through 18 is a transformer core 24 which is E-shaped in side cross-section (see the plan view in FIG. 2), wherein the transformer core engages with its limbs through the laminated multi-layer arrangement 20-10-22.

More precisely formed in the multi-layer portions 20 and 22 are edge openings 26 and a central opening 28 which are aligned with apertures 30 in the basic multi-layer member 10 so that the limbs of the transformer core 24, such limbs being directed downwardly into the plane of the drawing in the view in FIG. 2, engage through all three multi-layer layers and can be connected at the bottom side by a suitably associated core element which is not shown in greater detail in the Figures.

The conducting layers 14 of the basic multi-layer member and the further conducting layers 16, 18 of the multi-layer portions 20, 22 respectively provide an electrical connection to the further electronic components 32 on the multi-layer card 10 so that the planar inductance coil can be incorporated into the circuitry in the otherwise known manner.

As the plan views in FIG. 1 and FIG. 2 respectively show, the additional multi-layer portions 20, 22 extend over a portion of the multi-layer card 10 (on both sides thereof), wherein the additional portions 20, 22 lie on the base card 10 by means of an only small intermediate space 34 (see FIG. 3) and are connected to the base card 10 by additional adhesive connections 36, thereby providing a laminated arrangement of a plurality of substantially parallel conducting assemblies: in the case adopted by way of example where the basic multi-layer member has four conducting layers and the additional multi-layer portions 20, 22 each have five conducting layers, the region of the planar inductance coil thus involves a lamination arrangement of fourteen conducting layers which is only immaterially worsened in regard to the electrical and mechanical properties thereof in comparison with a single, fourteen-layer multi-layer member, but it requires only a fraction of the procurement or manufacturing costs. Furthermore adaptation to desired dimensions in virtually in any desired manner is possible by means of a suitable selection or dimensioning of the multi-layer portions 20, 22 to be applied, in which respect the invention is also not limited to for example the single-sided or double-sided arrangement of additional multi-layer portions as shown in the Figures, but on the contrary any suitable number of mutually superposed multi-layer portions can also be fixed (on one or both sides).

Reference will be made hereinafter to FIGS. 2 and 3 to describe a first way in which in accordance with the invention the additional multi-layer portions 20, 22 can be fixed on the basic multi-layer member 10. As the plan view in FIG. 2 shows, in the region of their narrow edges the multi-layer portions 20, 22 are respectively provided with a pair of lateral openings 38 which are in the form of peripheral millings and which are metallized in that region. As can also be seen from the side view in FIG. 3, the metallization also extends over an edge region of the top and bottom surfaces respectively of a respective multi-layer portion.

Those multi-layer portions 20, 22 are now fixed by means of suitably produced solder or weld points 40 in the regions of the metallized recesses 38 whereby the respective plate element can be secured on corresponding metallized fixing points 42 of the base plate 10 in a manner which is suitable for automated mounting and fixing (for example SMD).

The resulting arrangement which can be particularly clearly seen from the sectional view in FIG. 3 is then mechanically robust and stable and holds the individual conducting layers as closely together as possible so that, in the resulting planar inductance coil, only extremely low levels of leakage losses will be assumed to occur.

FIGS. 4 and 5 shows alternative possible ways in accordance with the invention of fixing one or more additional multi-layer portions on a multi-layer basic card 10 in the region of the planar inductance coil and providing for the variable formation thereof.

Thus, as shown in FIG. 4, an additional multi-layer portion 44 is connected to the basic card 10 by means of a clip or clamp element 46 which in turn engages at four points as shown in FIG. 2, wherein the clip elements 46 are introduced into suitable receiving openings 48 in the base card 10 and are secured there by means of a solder join or the like.

This configuration which is shown in FIG. 4 then admittedly involves a somewhat larger spacing between the base card 10 and the additional multi-layer member 44 (or the respective conducting layers), but it will be apparent that the arrangement in FIG. 4 permits easy interchangeable mounting of the additional multi-layer member.

A corresponding consideration applies in regard to the double-sided arrangement once again of a pair of multi-layer additional portions for a planar inductance coil as shown in FIG. 5, on both sides of the basic multi-layer member 10. This flexible fixing option is afforded by virtue of individual clips or clamps 50 which are once again arranged in a similar fashion to the arrangement referred to above and which are each soldered at the bottom side to fixing surfaces 52 of the basic multi-layer member 10. Alternatively the respective individual elements 50 can also be in the form of shaped members which extend over a respective edge length of the illustrated multi-layer portions 54.

The illustrated embodiments are to be interpreted as having been set forth purely by way of example and it is within the limits of the understanding of the man skilled in the art, on the basis of the above-described embodiments, to apply the principle of the invention to further suitable situations of use.

In particular it is possible to use as the base plate a multi-layer member which has at least two conducting layers; usually a multi-layer member which is employed in a practical context will have for example six conducting layers. Then, disposed thereon in a suitable manner and in dependence on the winding requirements, in the region of the inductance coil to be formed, are multi-layer portions which correspond to the required number of turns or the required turns ratio.

While in the described embodiment the secondary winding was preferably associated with the base plate as that often requires few turns, it will be appreciated that—depending on the respective situation of use —it is also possible to reverse the arrangement or to adopt a different configuration, for example using conducting layers of the base plate as the primary winding.

Also, the present invention is not limited to the described possible ways of implementing fixing and contacting for the additional multi-layer plate or plates to be fitted; thus it would also be possible in particular to provide contacting and fixing procedures which are known from the hybrid technology, for example in the form of a connecting comb.

As a supplemental consideration or alternatively, it seems possible to produce specific electrical contacts between a conductor of a mounted additional multi-layer member and a contact point on the base plate by bonding or a comparable connecting process.

Accordingly therefore there is provided an apparatus and a process which in accordance with the invention enjoy the advantages of multi-layer technology in terms of compactness, reproducibility in manufacture and mechanical load-bearing capability, supplemented by the possibility in a simple and flexible manner of designing a multi-layer planar inductor which can be configured in any manner, without the underlying basic multi-layer member for example having to be especially specifically designed for that purpose.

What is claimed is:

1. A multi-layer inductance coil on a first portion of a first plate-shaped support (10) which has a plurality of first conducting layers (14) which extend parallel to each other, and which support is made for holding and contacting further electronic components (32), wherein at least one conducting layer (14) of said plurality of first conducting layers, which forms a first electrical winding, is cooperating with a core (24) which is provided for guiding a magnetic flux and which is to be arranged in said first portion, wherein at least one second plate-shaped support (20; 22; 44; 54) with a plurality of second conducting layers (16; 18) is provided on said first portion, which layers extend substantially parallel to each other, said second support being parallel to said first support (10) such that at least one of the plurality of second conducting layers (16) of the second support, which provides a second electrical winding, can form an inductance with said core (24) and said first electrical winding, and wherein said second support is connected with said first support through laterally engaging connection elements, solder connection, or other contacting and fixing means.

2. A planar inductance coil as set forth in claim 1 characterized in that said second plate-shaped support is of a geometrical extent parallel to said first support, which is limited to said first portion.

3. A planar inductance coil as set forth in claim 1 or claim 2 characterized in that said at least one second plate-shaped support is arranged in mutually superposed aligned relationship on each of the two sides of said first support.

4. A planar inductance coil as set forth in claim 1 characterized in that said inductance coil is in the form of a transformer whose secondary winding is provided by said first electrical winding and whose primary winding is provided by said second electrical winding.

5. A planar inductance coil as set forth in claim 1 characterized in that said second support can be fixed to said first support by at least two holding elements (46, 60) which engage at oppositely disposed sides and which are fixed on said first support.

6. A planar inductance coil as set forth in claim 1 characterized in that said second support is connected to said first support by at least one laterally engaging solder connection.

7. A planar inductance coil as set forth in claim 1 characterized in that said second support can be fixed on said first support by means of an adhesive connection.

8. A planar inductance coil as set forth in claim 1 characterized in that said first support and said second support in the condition of being arranged one upon the other have at least one aligned opening (30) for a portion of said core (24) to pass therethrough.

9. A process for producing a multi-layer planar inductance coil, in particular as set forth in claim 1 characterized by the following steps:

forming a portion of a first plate-shaped support with a plurality of first conducting layers extending substantially parallel to each other, for accommodating a core provided for guiding a magnetic flux, arranging a second plate-shaped support with a plurality of first conducting layers extending substantially parallel to each other, in parallel relationship with the first support, and arranging said core on said first support and on said second support in such a way that a first electrical winding of said first support, a second electrical winding of said second support and said core can inductively co-operate.

* * * * *